United States Patent [19]

Hayashi et al.

[11] Patent Number: 4,686,942

[45] Date of Patent: Aug. 18, 1987

[54] COOLING SYSTEM FOR AUTOMOTIVE ENGINE OR THE LIKE

[75] Inventors: Yoshimasa Hayashi, Kamakura; Yasuhiro Murakami, Yokohama, both of Japan

[73] Assignee: Nissan Motor Co., Ltd., Yokohama, Japan

[21] Appl. No.: 751,537

[22] Filed: Jul. 3, 1985

[30] Foreign Application Priority Data

Jul. 4, 1984 [JP] Japan ..... 59-138815

[51] Int. Cl.[4] ..... F01P 3/22

[52] U.S. Cl. ..... 123/41.21; 123/41.27

[58] Field of Search ..... 123/41.2–41.27

[56] References Cited

U.S. PATENT DOCUMENTS

| | | | |
|---|---|---|---|
| 1,516,058 | 11/1924 | Porter | 123/41.2 |
| 2,766,740 | 10/1956 | Tacchella | 123/41.25 |
| 2,804,860 | 9/1957 | Tacchella et al. | 123/41.21 |
| 3,223,075 | 12/1965 | Barlow | 123/41.24 |
| 3,312,204 | 4/1967 | Barlow | 123/41.25 |
| 4,367,699 | 1/1983 | Evans | 123/41.33 |
| 4,499,866 | 2/1984 | Hirano | 123/41.21 |
| 4,570,579 | 2/1986 | Hirano | 123/41.21 |

*Primary Examiner*—William A. Cuchlinski, Jr,
*Attorney, Agent, or Firm*—Schwartz, Jeffery, Schwaab, Mack, Blumenthal & Evans

[57] ABSTRACT

In order to prevent large amounts of liquid coolant from boiling over from a coolant jacket of an evaporative cooling system wherein coolant vapor is used as a vehicle for removing heat from the engine to the condenser in which the coolant vapor is condensed, a vapor manifold is arranged to collect any liquid coolant before it reaches the radiator and return same to a relatively cool section of the coolant jacket.

9 Claims, 10 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is permitted to boil and the vapor used as a vehicle for removing heat from the engine, and more specifically to such a system which is compact and which prevents relatively large amounts of engine coolant from unwantedly "boiling over" particularly at high engine load/speed operation to the condensor or radiator of the system in a manner which wets the interior of the radiator to the point of reducing the efficiency with which the latent heat of evaporation of the coolant vapor can be released to the surrounding ambient atmosphere.

2. Description of the Prior Art

In currently used "water cooled" internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the necessary amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0,059,423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of "embolism" in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system.

The provision of the separation tank 6 also renders engine layout difficult in that such a tank must be placed at relatively high position with respect to the engine, and contain a relatively large amount of coolant so as to buffer the fluctuations in coolant consumption in the coolant jacket. That is to say, as the pump 11 which lifts the coolant from the small reservoir arrangement located below the radiator per se, is constantly energized (apparently to obivate the need for level sensors and the like arrangement which could control the amount of coolant returned to the coolant jacket) the amount of coolant stored in the seperation tank must be sufficient as to allow for sudden variations in the amount of coolant consumed in the coolant jacket due to sudden changes in the amount of fuel combusted in the combustion chambers of the engine.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with only gaseous coolant during engine operation during which liquid coolant is sprayed onto the ceramic layers 12. However, this arrangement has proven totally unsatisfactory in that upon boiling of the liquid coolant absorbed into the eramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is plagued with air contamination and blockages in the radiator similar to the compressor equipped arrangement discussed above.

FIG. 7 shows an arrangement which is disclosed in copending U.S. patent application Ser. No. 663,911 filed on Oct. 23, 1984 in the name of Hirano, now U.S. Pat. No. 4,549,505. The disclosure of this application is hereby incorporated by reference thereto.

This arrangement while overcoming the problems inherent in the above discussed prior art itself suffers from the drawback that upon entering a mode of operation wherein a relatively large amount of fuel is combusted in each combustion chamber of the engine per cycle, the violent boiling of the coolant which occurs in the coolant jacket induces the situation wherein relatively large quantities of liquid coolant tend to be transferred across to the radiator along with the coolant vapor. This wets the interior of the radiator reducing the heat exchange efficiency thereof. While it is possible to add a seperation tank of the nature disclosed in USP at NO. 4,367,699 this provision is very difficult as the amount of space which is available in confines of modern automotive vehicles is very limited and if used severely hampers access to the various parts of the engine during servicing of the engine.

For convenience the same numerals as used in the above mentioned patent application are also used in FIG. 7.

SUMMARY OF THE PRESENT INVENTION

It is an object of the present invention to provide a cooling system for an internal combustion engine or the like device which permits liquid coolant to boil and uses the vapor generated as a vehicle for removing heat from the engine and which features a compact arrangement via which boiling coolant boils over during high engine load or the like mode of operation can be prevented from entering the radiator of the system and thus avoid heat exchange efficiency reductions at times when such is vital.

In brief, the above object is achieved by an arrangement wherein order to prevent large amounts of liquid coolant from boiling over from a coolant jacket of an evaporative cooling system wherein coolant vapor is used as a vehicle for removing heat from the engine to the condensor in which the coolant vapor is condensed, a vapor manifold is arranged to collect any liquid coolant entering same before it reaches the radiator and return same to a relatively cool section of the coolant jacket.

More specifically, the present invention takes the form of an internal combustion engine which has a structure subject to high heat flux, a cooling system for removing heat from the structure, the system comprising: (a) a cooling circuit which includes: (i) a coolant jacket formed about the structure and into which coolant is introduced in liquid form and permitted to boil, (ii) a radiator in which gaseous coolant is condensed to its liquid state; (iii) a vapor manifold fluidly communicating with the coolant jacket; (iv) a vapor transfer conduit leading from the vapor manifold to the radiator; (v) means defining a liquid coolant collection section in the vapor manifold into which liquid coolant emitted from the coolant jacket is collected; (vi) means defining a drain port in the collection section; (vii) a drain conduit leading from the drain port to the coolant jacket; (viii) coolant return means for returning liquid coolant from the radiator to the coolant jacket in a manner to maintain the structure immersed in a predetermined depth of liquid coolant; (b) a reservoir containing liquid coolant; and (c) valve and conduit means for selectively interconnecting the cooling circuit with the reservoir.

BRIEF DESCRIPTION OF THE DRAWINGS

The features and advantages of the arrangement of the present invention will become more clearly appreciated from the following description taken in conjunction with the accompanying drawings in which.

Figure 7:
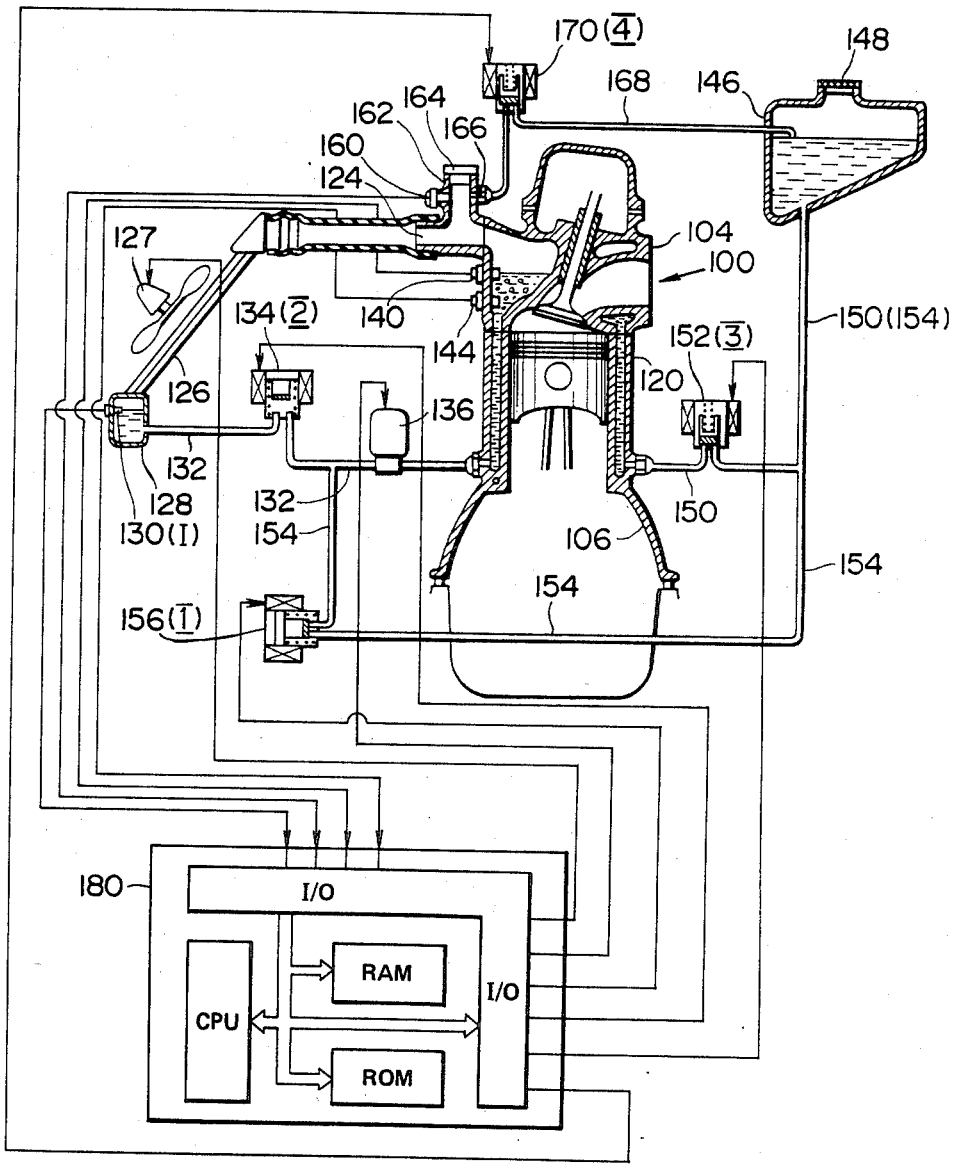
FIG. 7 shows in schematic elevation the "internally known" arrangement disclosed in the opening paragraphs of the instant disclosure in conjunction with copending US Ser. No. 663,911, now U.S. Pat. No. 4,549,505.
Figure 8:
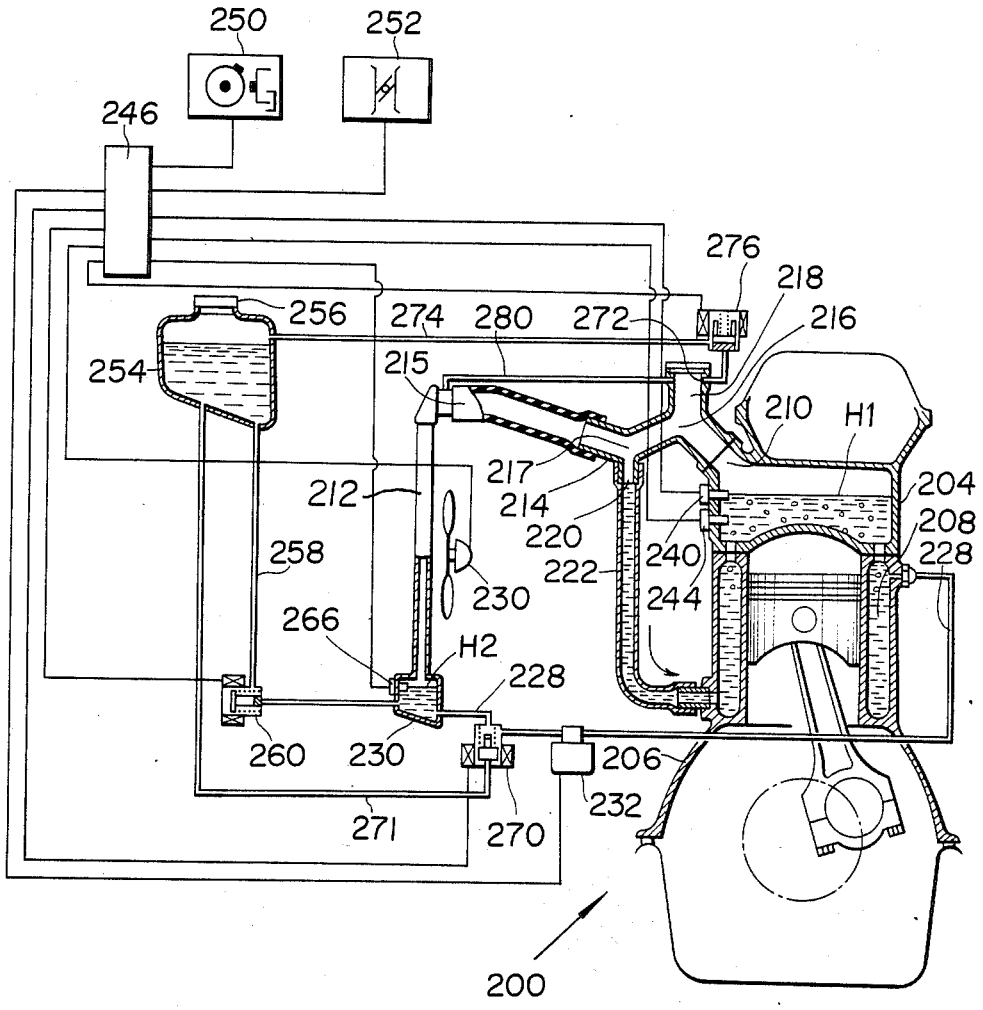
FIG. 8 shows in sectional elevation a first embodiment of the present invention.
Figure 9:
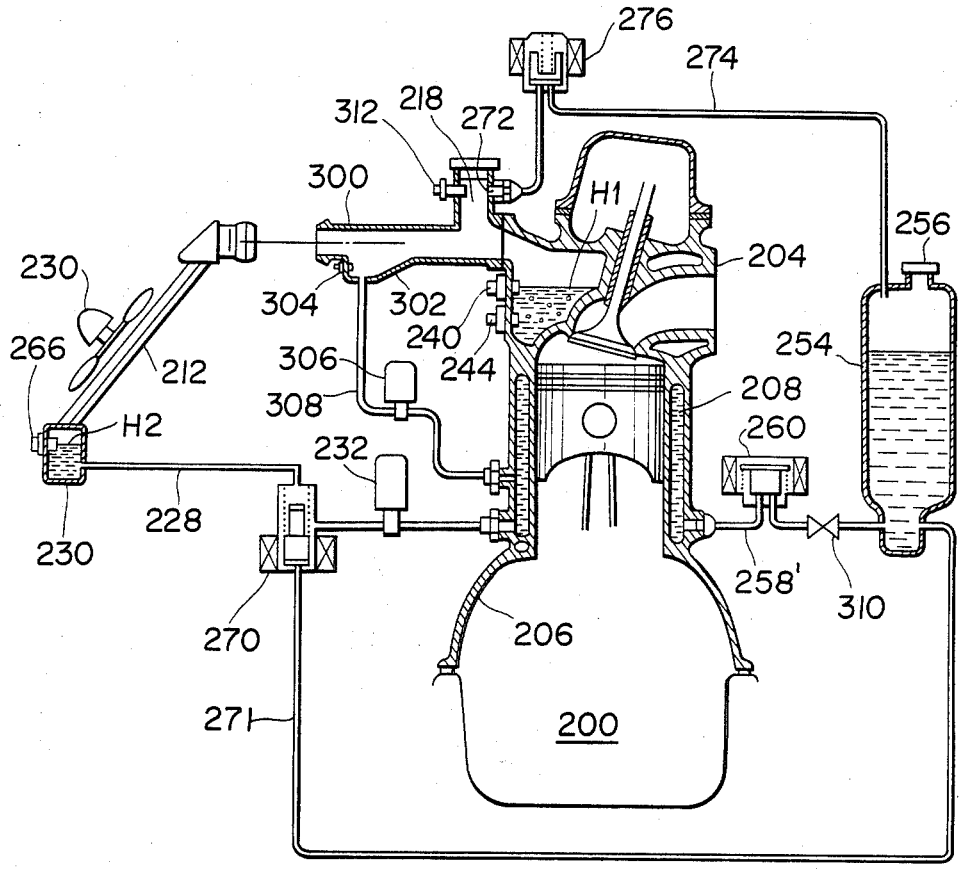
FIG. 9 is a sectional view of a second embodiment of the present invention.

with the arrangements shown in FIGS. 7 and the embodiments of the invention shown in FIGS. 8 and 9.

DETAILED DESCRIPTION OF THE PREFERRED EMBODIMENTS

Before proceeding with the description of the embodiments of the present invention, it is deemed appropriate to discuss the concept on which the present invention is based.

Figure 1:
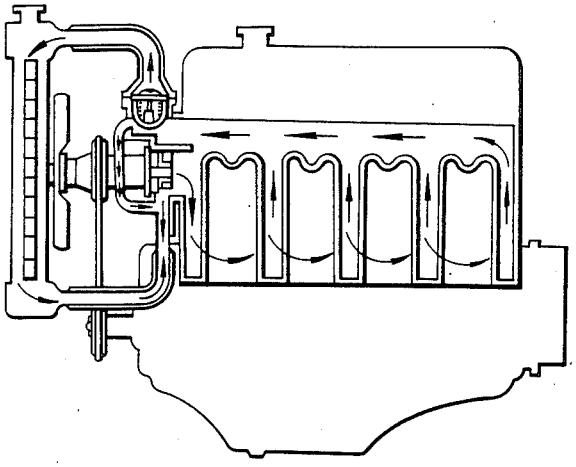
FIG.1 (PRIOR ART)
FIG. 1 is a partially sectioned elevation showing the currently used conventional water circulation type system discussed in the opening paragraphs of the instant disclosure.
Figure 2:
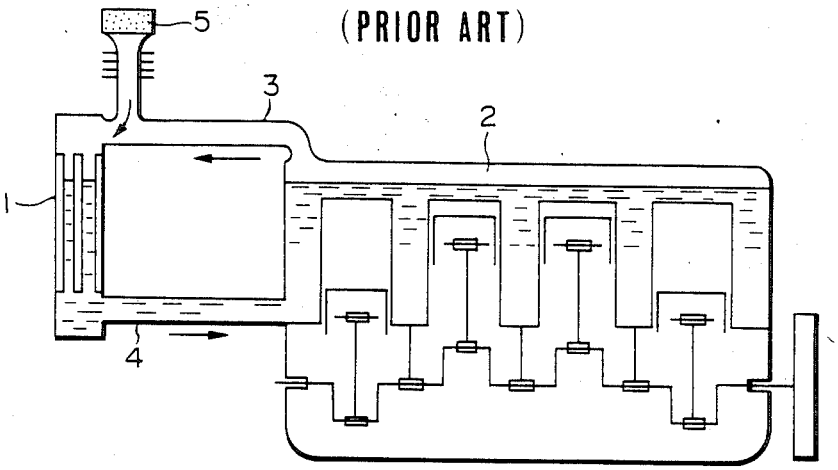
FIG.2 (PRIOR ART)
FIG. 2 is a schematic side sectional elevation of a prior art arrangement also discussed briefly in the earlier part of the specification.
Figure 3:
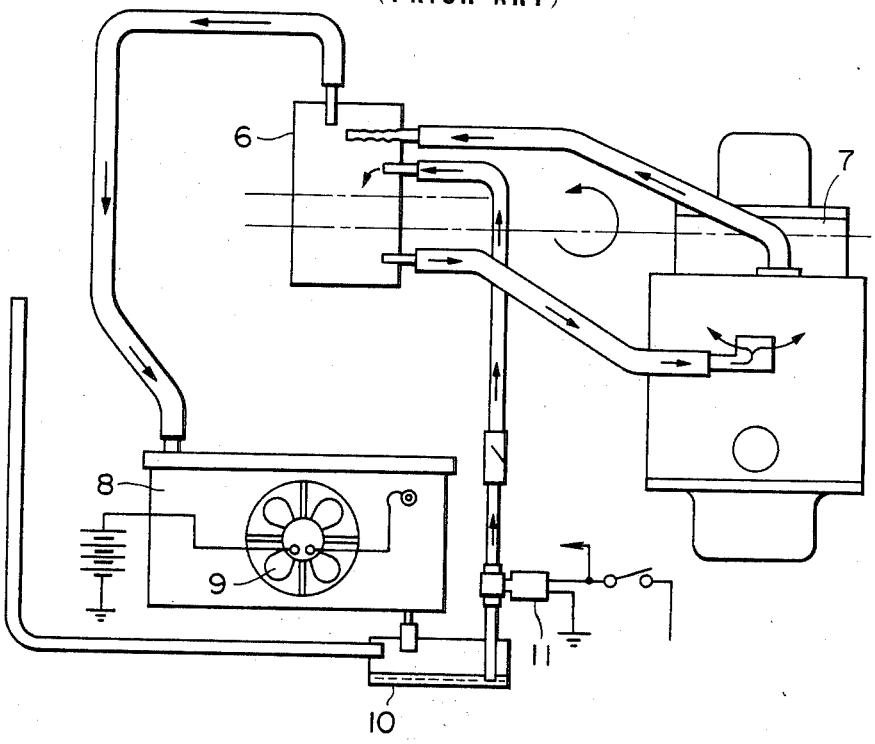
FIG. 3 (PRIOR ART)
FIG. 3 shows in schematic layout form, another of the prior art arrangements previously discussed.
Figure 4:
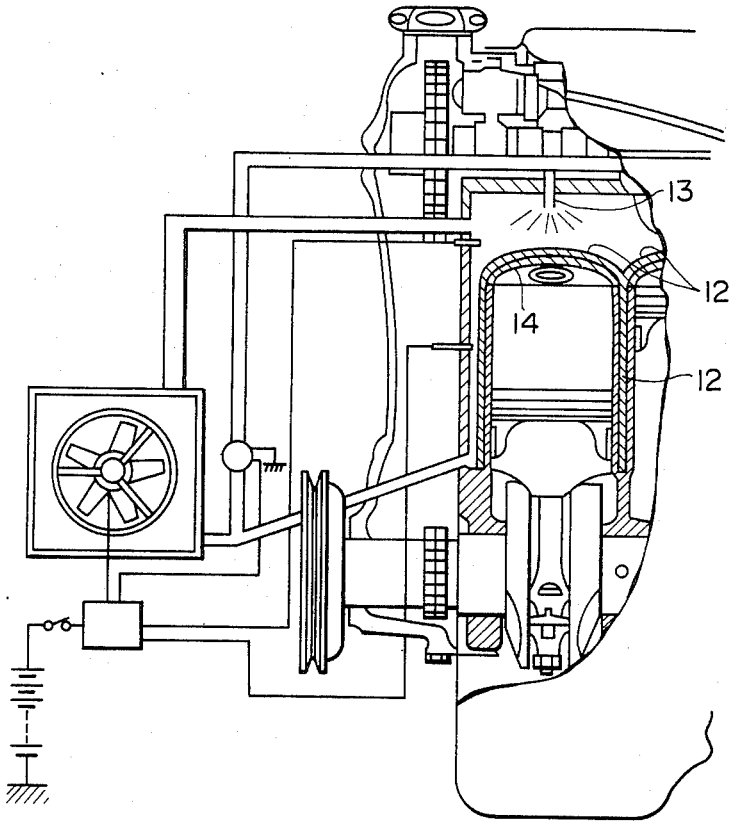
FIG.4 (PRIOR ART)
FIG. 4 shows in partial section yet another of the previously discussed prior art arrangements.
Figure 5:
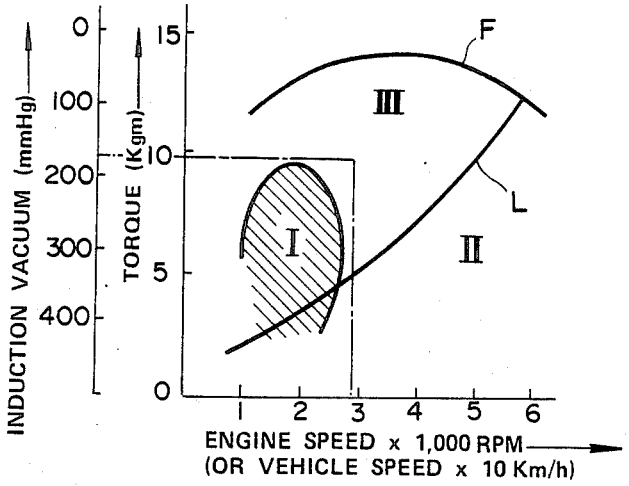
FIG. 5 is a graph showing in terms of induction vacuum (load) and engine speed the various load zones encountered by an automotive internal combustion engine.
Figure 6:
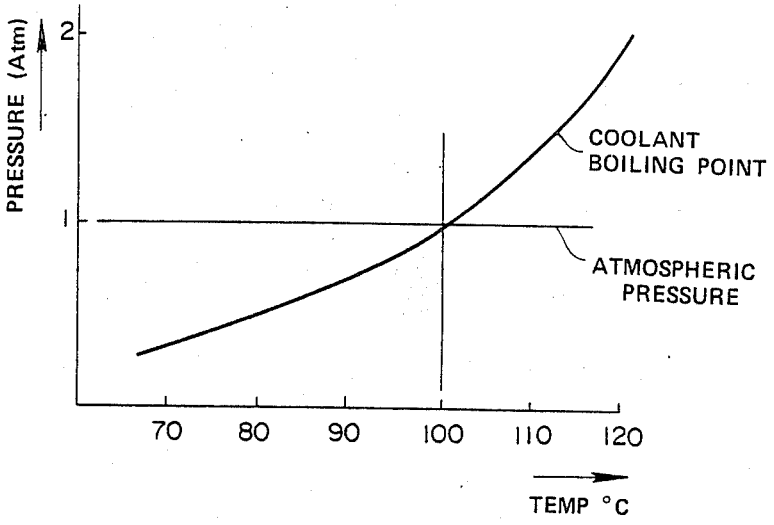
FIG. 6 is a graph showing in terms of pressure and temperature, the change which occurs in the coolant boiling point with change in pressure.

FIG. 5 graphically shows in terms of engine torque and engine speed the various load "zones" which are encountered by an automotive vehicle engine. In this graph, the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing, etc.).

A suitable coolant temperature for zone I is approximately 110° C. while 90°–80° C. for zones II and III. The high temperature during "urban cruising" promotes improved charging efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximatey 1.9 Atmospheres).

On the other hand, during high speed cruising, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendancy for air to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

FIG. 8 shows an engine system incorporating a first embodiment of the present invention. In this arrangement, an internal combustion engine 200 includes a cylinder block 206 on which a cylinder head 204 is detachably secured. The cylinder head and cylinder block include suitable cavities which define a coolant jacket 208 about the heated structure of the cylinder head and block.

Fluidly interconnecting a vapor discharge port 210 formed in the cylinder head 204 and a radiator or heat exchanger 212, are a vapor manifold 214 and vapor transfer conduit 215. In this embodiment the manifold 214 is arranged to have two elbow shaped sections 216, 217 which as shown, are arranged in series. A riser 218 extends upwardly from the first of these elbow section 216 while a liquid coolant drain port 220 is formed in the valley like arrangement defined by the second (217) of the two elbows. A drain conduit 222 leads from the drain port 220 to the coolant jacket 208. In this embodiment the drain conduit 222 communicates with the lowermost section of the coolant jacket 208 so that upon relatively large amounts of coolant boiling over, circulation of coolant within the coolant jacket per se is promoted. Viz., the boiling coolant is re-introduced into the coolant jacket at a location subject relatively weak heating and thus to some extent tends to unify the temperature of the engine block.

As will be appreciated from FIG. 8 it is necessary to arrange for the drain port 220 to be located at or above a level H1 at which the level of liquid coolant in the coolant jacket 208 is maintained so as to maximize the collection capacity of the second elbow section 217.

With the manifold 214 shown in FIG. 8 upon the boiling in the coolant jacket becomming so vigorous as to induce liquid coolant to bump and/or froth to the extend of flowing out of the coolant jacket 208 into the vapor manifold 214, firstly the froth must ascend toward the riser section 218, then decend toward the drain port 220 and thereafter again ascend toward the vapor transfer conduit 215 which interconnects the vapor manifold 214 and the radiator 212. With this arrangement any liquid coolant which actually makes it over the hump located below the riser 218 tends to collect in the valley like arrangement into which the drain port 220 opens. Accordingly, very little liquid coolant actually enters the vapor transfer conduit 215 which also is arranged to slant upwardly in the direction of the radiator 212. This inclination also induces any liquid that actually manages to enter same to drain back toward the drain port 220. Hence, the interior of the radiator 212 can be (when desired) maintained essentially dry thus maximizing the surface area available for heat exchange.

Located suitably adjacent the radiator 212 is a electrically driven fan 226. Disposed in a coolant return conduit 228 which leads from a small collection reservoir 230 or lower tank as it will be referred to hereinafter to an upper section of the coolant jacket defined within the cylinder block 206, is a return pump 232.

In order to control the level of coolant in the coolant jacket 208, a level sensor 240 is disposed as shown. It will be noted that this sensor is located at level (H1) which is higher than that of the combustion chambers, exhaust ports and valves (structure subject to high heat flux) so as to maintain same securely immersed in liquid coolant and therefore attenuate engine knocking and the like due to the formation of localized zones of abnormally high temperature of "hot spots".

Located below the level sensor 240 so as to be immersed in the liquid coolant is a temperature sensor 244. The output of the level sensor 240 and the temperature sensor 244 are fed to a control circuit 246 or modulator which is suitably connected with a source of EMF (not shown).

The control circuit 246 further receives an input from the engine distributor 250 (or like device) indicative of engine speed and an input from a load sensing device 252 such as a throttle valve position sensor. It will be noted that as an alternative to throttle position, the output of an air flow meter, an induction vacuum sensor or the pulse width of a fuel injection control signal may be used to indicate load.

A coolant reservoir 254 is located beside the radiator 212 as shown. A small air bleed (not shown) formed in the reservoir cap 257 permits atmospheric pressure to continuously prevail therein.

The reservoir 254 fluidly communicates with the cooling circuit via a fill/displacement conduit 258 and an electromagnetic valve 260. This valve is closed when energized. As shown, conduit 258 is arranged to communicate with lower tank 230.

A second level sensor 266 is disposed in the lower tank 230 and arranged to sense the level of liquid coolant being at or above a level H2.

Leading from reservoir 254 to a three-way valve 270 disposed in the return conduit 228 at a location between pump 232 and the lower tank 230 is a coolant supply conduit 271. The three-way valve 270 is arranged to normally assume a position wherein communication between the lower tank 230 and the pump 232 is established and assume a position wherein communication between the reservoir 254 and the pump 232 is established when the valve 270 is energized.

Leading from a purge port 272 formed in the riser 218 is an overflow conduit 274. Disposed in this conduit 274 is a normally closed electromagnetic valve 276. This valve is arranged to be open (via energization) only during a non-condensible matter purge routine which will be described hereinlater.

Leading from the top of the radiator 212 to the a port 278 located at the same level in the riser 218 as the purge port 272 is an air transfer conduit 280. This conduit 280 is provided in order to compensate for the shape of the vapor manifold 214 which would tend to prevent bubbles of air from being displaced from the radiator 212 to the purge port 272 during the purge operation and to allow for easy transfer of any small bubbles of air or the like non-condensible matter from the radiator to the aforementioned riser 218.

Prior to use the cooling circuit is filled to the brim with coolant (for example water or a mixture of water and antifreeze or the like) and the cap 257 securely set in place to seal the system. A suitable quantity of additional coolant is also placed in the reservoir 254. At this time the electromagnetic valve 260 should be temporarily energized or a similar precaution be taken to facilitate the complete filling of the system and the exclusion of any air.

When the engine is started the control circuit 246 samples the output of temperature sensor 244 and if the temperature of the coolant is below a predetermined level (45° C. for example) the engine is deemed to be cold and a purge routine executed in order to ensure that prior to being put into operation, the system is completely free from contaminating air which will drastically reduce the heat exchanger of radiator 212.

In order to execute this routine valve 260 is closed via energization, three-way valve 270 conditioned (via energization) to establish fluid communication between the reservoir 254 and pump 232 via conduit 271 while pump 232 and valve 276 are energized. Under these conditions coolant is inducted from the reservoir 254 and forced into the essentially full cooling circuit (viz., the coolant jacket 208, vapor manifold 214, vapor transfer conduit 224 radiator 212 and coolant return conduit 232). According, the excess coolant which is forced into the system flows up through the radiator 212 (in this embodiment) and overflows out through the overflow conduit 274 back to the reservoir 254. This flushes out any air that might have accumulated in the system and thus places the same in condition ready for the excess coolant in the cooling circuit to be displaced out to the reservior 254 until the levels in the coolant jacket 208 and lower tank 230 reach levels H1 and H2 respectively.

Following the purge operation valves 260, 270 and 276 are de-energized to cut off communication between the riser 218 and the reservoir 254, open conduit 258 and condition valve 270 to communicate pump 232 with lower tank 230.

As the cooling circuit is completely filled with stagnant coolant, the heat produced by the combustion in the combustion chambers of the engine cannot be readily released via the radiator 212 to the ambient atmosphere and the coolant rapidly warms and begins to produce coolant vapor. At this time as valve 260 is left de-energized the pressure of the coolant vapor begins displacing liquid coolant out of the cooling circuit (viz., the coolant jacket 220, vapor manifold 282, vapor conduit 284, radiator 226, lower tank 264 and the return conduit 232) via conduit 258.

During this "coolant displacement mode" it is possible for either of two situations to occur. That is to say, it is possible for the level of coolant in the coolant jacket 220 to be reduced to level H1 before the level in the radiator reaches level H2 or vice versa wherein the radiator 226 is emptied before much of the coolant in the coolant jacket is displaced. In the event that latter occurs (viz., the coolant level in the radiator 226 falls to H2 before that in the coolant jacket 220 reaches H1), valve 260 is temporarily closed and the coolant in the coolant jacket allowed to "distill" across to the radiator. Alternatively, if the level H1 is reached first, level sensor 240 induces the energization of pump 234 and coolant is pumped from the radiator to the coolant jacket 232 while simultaneously being displaced out through conduit 258 to reservoir 254.

During this displacement mode, the load and other operational parameters of the engine are sampled and a decision made as to the temperature at which the coolant should be controlled to boil. If the desired temperature is reached before the amount of the coolant in the cooling circuit is reduced to the minimum quantity (viz., when the coolant in the coolant jacket and the radiator are at levels H1 and H2 respectively) it is possible to energize valve 260 so that is assumes a closed state and places the cooling circuit in a hermetically closed condition. If the temperature at which the coolant boils should exceed that determined to be best suited for the instant set of engine operational conditions, the circuit may be subsequently reopened and additional coolant displaced out to reservoir 254 to increase the surface "dry" surface area of the radiator 226 available for the coolant vapor to release its latent heat of evaporation.

When the engine is stopped it is advantageous to maintain valve 260 energized until the temperature of the coolant falls to 80° C. (for example). This obviates the problem wherein large amounts of coolant are violently discharged from the cooling circuit due to the presence of superatmospheric pressure therein.

FIG. 9 shows a second embodiment of the present invention. This embodiment differs from the first one in that the zig-zag shaped vapor manifold 214 is replaced with one (300) that is relatively straight and formed with a liquid coolant collection pocket 302. A level sensor 304 is disposed in the manifold 300 and arranged to extend into the collection pocket 302 in a manner to sense the presence of liquid coolant therein. A drain pump 306 is disposed in a drain line 308 that leads from the bottom of the collection pocket 302 to the coolant jacket 208. This pump 306 is arranged to be responsive to the level sensor 304 indicating that an amount of coolant has collected in the pocket 302 and need be transferred back into the coolant jacket 208.

A further difference between the this embodiment that and shown in FIG. 8 comes in that conduit 258' leads from the reservoir 254 to the coolant jacket 208 rather than the lower tank 230. A small manually operable valve 310 is disposed in conduit 258' at a location between the reservoir and electromagnetic valve 260 for facilitating servicing of the system.

With the just described arrangement during operation of the engine should the boiling of the coolant become so vigorous as to induce liquid coolant to "boil over" into the vapor manifold 300, sensor 304 energized drain pump 306 and returns any liquid discharged from the upper section of the coolant jacket 208 back into a section thereof which surround engine structure which is not subject to a heat flux of the degree that the engine cylinder head is. In this embodiment a level sensor 312 is disposed in the riser 218 and arranged to sense whether the cooling circuit is absolutely full of coolant when the engine undergoes a "cold start". Viz., if the temperature of the coolant is below 45° C. when the engine is started and the level sensor 312 indicates that the cooling circuit is completely full of coolant, then the purge operation can be dispensed with and the system allowed to directly enter the displacement phase wherein the excess coolant which enters and fills the circuit each time the engine is stopped, is displaced back out to the reservoir 254. However, if the engine coolant is below the above mentioned limit and level sensor 312 indicates that the level of coolant is slightly lower than the sensor, then the pump can be energized until such time as the level rises above same.

Although not set forth hereinbefor, it will be understood that once the engine is stopped and has cooled sufficiently, the coolant in the reservior 254 is allowed to be inducted into the cooling circuit under the influence of the pressure differential which develops between the atmosphere and the interior of the cooling circuit as the coolant vapor condenses to its liquid form.

In the event that when the engine is restarted and the engine coolant is above 45° C. then it is assumed that there has been insufficient time for contaminating air to enter the system and the purge operation is omitted.

It will be noted that the air transfer conduit 280 of the first embodiment is omitted from the arrangement shown in FIG. 9 as the vapor manifold 300 does not have a configuration which will tend to trap air or the like non-condensible matter in the system.

Figure 10:
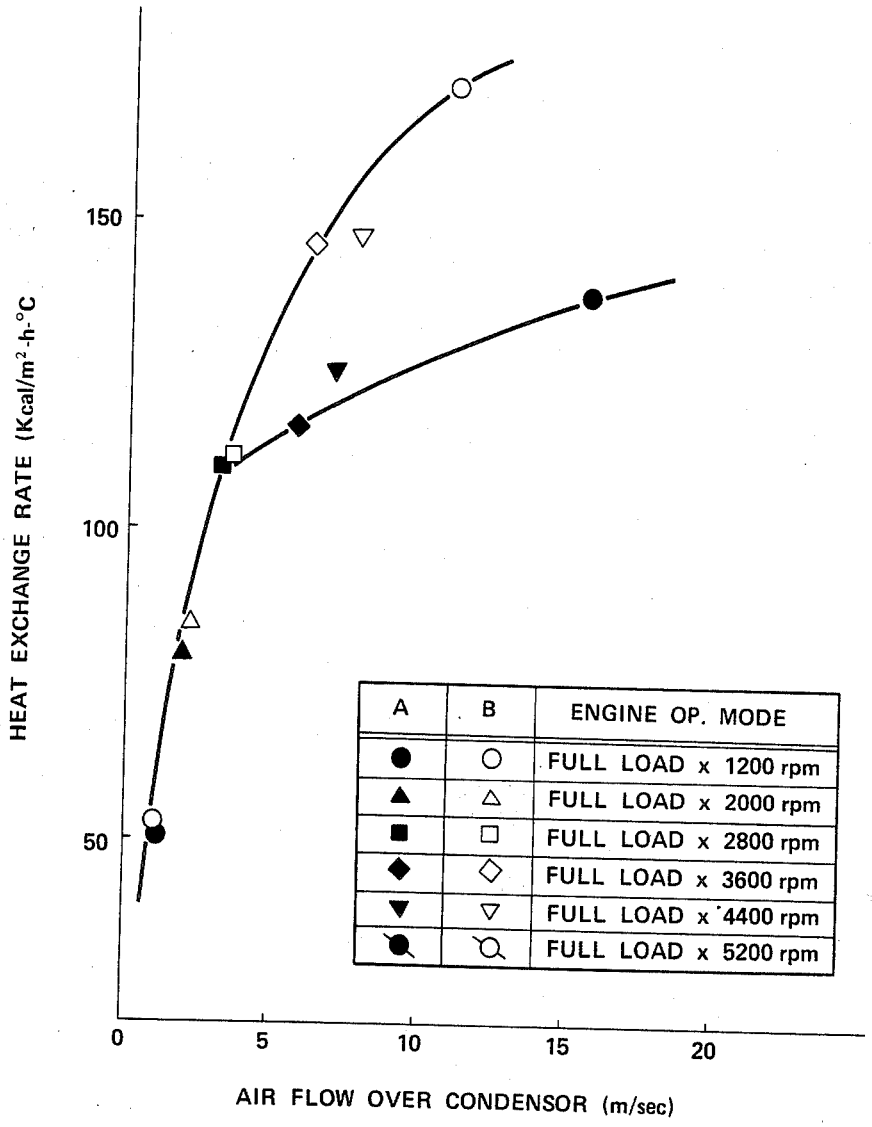
FIG. 10 is a graph showing in terms of the rate of heat exchange between the radiator and the ambient atmosphere and the rate of flow of air over the surface of the radiator, the changes in heat exchange efficiency which occur with change in engine speed (under full load)

FIG. 10 shows in graphical form the improved performance of the embodiments shown in FIGS. 8 and 9 over the arrangement shown in FIG. 7. As will be apparent above 2800 RPM the efficiency of the FIG. 7 arrangement begins to fall off while that of the embodiments of the present invention exhibit good performance up until approximately 5000 RPM. This increase in efficiency is attributable to the reduced amount of liquid coolant which is permitted to reach the radiator.

What is claimed is:

1. In an internal combustion engine: a structure subject to high heat flux a cooling system for removing heat from said structure, said system comprising:

(a) a cooling circuit including:

(i) a coolant jacket formed about said structure and into which coolant is introduced in liquid form and permitted to boil;

(ii) a radiator in which gaseous coolant is condensed to its liquid state;

(iii) a vapor manifold fluidly communicating with said coolant jacket;

(iv) a vapor transfer conduit leading from said vapor manifold to said radiator;

(v) means defining a liquid coolant collection section in said vapor manifold into which liquid coolant emitted from said coolant jacket is collected;

(vi) means defining a drain port in said collection section;

(vii) a drain conduit leading from said drain port to said coolant jacket;

(viii) coolant return means for returning liquid coolant from said radiator to said coolant jacket in a manner to maintain said structure immersed in a predetermined depth of liquid coolant including:

a level sensor disposed in said coolant jacket at a level which is higher than said structure subject to high heat flux;

a coolant return conduit which leads from the bottom of said radiator to said coolant jacket;

a coolant return pump disposed in said coolant return conduit, said coolant return pump being responsive to said sensor to pump coolant from said radiator to said coolant jacket in a manner to maintain the level of coolant in said coolant jacket at that of said level sensor;

(b) a reservoir containing liquid coolant; and (c) valve and conduit means for selectively interconnecting said cooling circuit with said reservoir.

2. An internal combustion engine as claimed in claim 1, wherein said vapor manifold comprises:

a first upwardly inclined section;

a downwardly inclined section leading from said first upwardly inclined section;

a second upwardly inclined section leading from said downwardly inclined section to said vapor transfer conduit;

said drain port being located at the intersection of said downwardly inclined section and said second upwardly inclined section;

a riser section formed at the intersection of said first upwardly extending section and said downwardly extending one; and an essentially straight by-pass conduit which leads from said radiator to said riser at a level which is higher than said upwardly and downwardly extending sections.

3. An internal combustion engine as claimed in claim 1, wherein said means defining a liquid coolant collection section in said vapor manifold comprises:

means defining a liquid coolant collection pocket;

said drain port opening into the bottom of said pocket;

and wherein said engine further comprises;

a level sensor disposed in said pocket for sensing the presence of liquid coolant therein;

a drain pump disposed in said drain conduit, said drain pump being responsive to said level sensor indicating the presence of liquid coolant in said pocket to pump said liquid coolant from said pocket to said coolant jacket.

4. An internal combustion engine as claimed in claim 1, wherein said valve and conduit means comprises:

a first valve disposed in said coolant return conduit at a location between said radiator and said second pump;

a coolant supply conduit leading from said reservoir to said first valve, said first valve having a first position wherein communication between said radiator and said pump is established and a second position wherein communication between said reservoir and said pump is established;

a fill/discharge conduit leading from said reservoir said cooling circuit;

a second valve disposed in said fill/discharge conduit, said second valve having a first position wherein fluid communication between said reservoir and said cooling circuit is established and a second position wherein the communication is cut off;

an overflow conduit leading from a purge port formed in said vapor manifold to said reservoir; and a third valve disposed in said overflow conduit, said third valve having a first normal position wherein communication between said vapor manifold and said reservoir is interrupted and a second position wherein the communication is permitted.

5. An internal combustion engine as claimed in claim 1, further comprising:

a first parameter sensor disposed in said coolant jacket for sensing a parameter which varies with the temperature of the coolant in said coolant jacket;

a second parameter sensor which senses a parameter which varies with the load on said engine;

a device disposed with said radiator for varying the heat exchange between said radiator and a cooling medium surrounding said radiator;

a control circuit responsive to the outputs of said first and second parameters sensors for controlling said device in a manner which tends to bring the temperature of the coolant in said coolant jacket to a value most appropriate for the instant load on said engine.

6. In an internal combustion engine a structure subject to high heat flux a cooling system for removing heat from said structure, said system comprising:

(a) a cooling circuit including:

(i) a coolant jacket formed about said structure and into which coolant is introduced in liquid form and permitted to boil;

(ii) a radiator in which gaseous coolant is condensed to its liquid state;

(iii) a vapor manifold fluidly communicating with said coolant jacket including:

a first upwardly inclined section;

a downwardly inclined section leading from said first upwardly inclined section;

a second upwardly inclined section connected to said downwardly inclined section;

a vapor transfer conduit connected between said second upwardly inclined section and said radiator;

a drain port being located at the intersection of said downwardly inclined section and said second upwardly inclined section;

a riser section formed at the intersection of said first upwardly extending section and said downwardly extending one; and an essentially straight by-pass conduit which leads from said radiator to said riser at a level which is higher than said upwardly and downwardly extending sections;

(iv) a vapor transfer conduit leading from said vapor manifold to said radiator;

(v) means defining a liquid coolant collection section in said vapor manifold into which liquid coolant emitted from said coolant jacket is collected;

(vi) means defining a drain port in said collection section;

(vii) a drain conduit leading from said drain port to said coolant jacket;

(viii) coolant return means for returning liquid coolant from said radiator to said coolant jacket in a manner to maintain said structure immersed in a predetermined depth of liquid coolant;

(b) a reservior containing liquid coolant; and (c) valve and conduit means for selectively interconnecting said cooling circuit with said reservoir.

7. In an internal combustion engine a structure subject to high heat flux a cooling system for removing heat from said structure, said system comprising:

(a) a cooling circuit including:

(i) a coolant jacket formed about said structure and into which coolant is introduced in liquid form and permitted to boil;

(ii) a radiator in which gaseous coolant is condensed to its liquid state;

(iii) a vapor manifold fluidly communicating with said coolant jacket including:

means defining a liquid coolant collection pocket;

said drain port opening into the bottom of means defining a pocket;

a level sensor disposed in said pocket for sensing the presence of liquid coolant therein;

a drain conduit leading from said drain port to said coolant jacket;

a drain pump disposed in said drain conduit, said drain pump being responsive to said level sensor indicating the presence of liquid coolant in said pocket to pump said liquid coolant from said pocket to said coolant jacket;

(iv) a vapor transfer conduit leading from said vapor manifold to said radiator; and (v) coolant return means for returning liquid coolant from said radiator to said coolant jacket in a manner to maintain said structure immersed in a predetermined depth of liquid coolant;

(b) a reservoir containing liquid coolant; and (c) valve and conduit means for selectively interconnecting said cooling circuit with said reservoir.

8. In an internal combustion engine a structure subject to high heat flux a cooling system for removing heat from said structure, said system comprising:

(a) a cooling circuit including:
(i) a coolant jacket formed about said structure and into which coolant is introduced in liquid form and permitted to boil;
(ii) a radiator in which gaseous coolant is condensed to its liquid state;
(iii) a vapor manifold fluidly communicating with said coolant jacket;
(iv) a vapor transfer conduit leading from said vapor manifold to said radiator;
(v) means defining a liquid coolant collection section in said vapor manifold into which liquid coolant emitted from said coolant jacket is collected;
(vi) means defining a drain port in said collection section;
(vii) a drain conduit leading from said drain port to said coolant jacket;
(viii) coolant return means for returning liquid coolant from said radiator to said coolant jacket in a manner to maintain said structure immersed in a predetermined depth of liquid coolant;
(b) a reservoir containing liquid coolant; and
(c) valve and conduit means for selectively interconnecting said cooling circuit with said reservoir comprising:
(i) a first valve disposed in said coolant return conduit at a location between said radiator and said second pump;
(ii) a coolant supply conduit leading from said reservoir to said first valve, said first valve having a first position wherein communication between said radiator and said pump is established and a second position wherein communication between said reservoir and said pump is established;
(iii) a fill/discharge conduit leading from said reservoir to said cooling circuit;
(iv) a second valve disposed in said fill/discharge conduit, said second valve having a first position wherein fluid communication between said reservoir and said cooling circuit is established and a second position wherein the communication is cut off;
(v) an overflow conduit leading from a purge port formed in said vapor manifold to said reservoir; and
(vi) a third valve disposed in said overflow conduit, said third valve having a first normal position wherein communication between said vapor manifold and said reservoir is interrupted and a second position wherein the communication is permitted.

9. In an internal combustion engine a structure subject to high heat flux a cooling system for removing heat from said structure, said system comprising:
(a) a cooling circuit including:
(i) a coolant jacket formed about said structure and into which coolant is introduced in liquid form and permitted to boil;
(ii) a radiator in which gaseous coolant is condensed to its liquid state;
(iii) a vapor manifold fluidly communicating with said coolant jacket;
(iv) a vapor transfer conduit leading from said vapor manifold to said radiator;
(v) means defining a liquid coolant collection section in said vapor manifold into which liquid coolant emitted from said coolant jacket is collected;
(vi) means defining a drain port in said collection section;
(vii) a drain conduit leading from said drain port to said coolant jacket;
(viii) coolant return means for returning liquid coolant from said radiator to said coolant jacket in a manner to maintain said structure immersed in a predetermined depth of liquid coolant;
(b) a reservoir containing liquid coolant;
(c) valve and conduit means for selectively interconnecting said cooling circuit with said reservoir;
(d) a first parameter sensor disposed in said coolant jacket for sensing a parameter which varies with the temperature of the coolant in said coolant jacket;
(e) a second parameter sensor which senses a parameter which varies with the load on said engine;
(f) a device disposed with said radiator for varying the heat exchange between said radiator and a cooling medium surrounding said radiator; and
(g) a control circuit responsive to the outputs of said first and second parameters sensors for controlling said device in a manner which tends to bring the temperature of the coolant in said coolant jacket to a value most appropriate for the instant load on said engine.

* * * * *